US007198203B2

(12) United States Patent
Brenk et al.

(10) Patent No.: US 7,198,203 B2
(45) Date of Patent: Apr. 3, 2007

(54) FUEL INJECTOR WITH AND WITHOUT PRESSURE AMPIFICATION WITH A CONTROLLABLE NEEDLE SPEED AND METHOD FOR THE CONTROLLING THEREOF

(75) Inventors: Achim Brenk, Kaempfelbach-Bilfingen (DE); Martin Kropp, Tamm (DE); Manfred Mack, Altheim (DE); Juergen Hammer, Fellbach (DE); Reinhard Tampe, Hemmingen (DE); Heike Bastian, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/520,108

(22) PCT Filed: Jul. 10, 2003

(86) PCT No.: PCT/DE03/02317

§ 371 (c)(1),
(2), (4) Date: Jan. 3, 2005

(87) PCT Pub. No.: WO2004/016936

PCT Pub. Date: Feb. 26, 2004

(65) Prior Publication Data

US 2005/0263621 A1 Dec. 1, 2005

(30) Foreign Application Priority Data

Jul. 29, 2002 (DE) ..... 102 34 447
Dec. 10, 2002 (DE) ..... 102 57 641

(51) Int. Cl.
*F02M 41/16* (2006.01)

(52) U.S. Cl. ..... 239/96; 239/88; 239/102.2; 239/533.8; 123/467; 123/500; 123/299; 123/300

(58) Field of Classification Search ..... 239/533.8, 239/539.9, 533.4, 585.1, 102.2, 88, 96
See application file for complete search history.

(56) References Cited

U.S. PATENT DOCUMENTS 4,185,779 A * 1/1980 Watson ..... 239/533.3
5,460,329 A * 10/1995 Sturman ..... 239/96
5,477,834 A * 12/1995 Yoshizu ..... 123/501
5,722,373 A * 3/1998 Paul et al. ..... 123/446
5,954,030 A * 9/1999 Sturman et al. ..... 123/446
6,073,862 A * 6/2000 Touchette et al. ..... 239/408
6,298,822 B1 * 10/2001 Radue ..... 123/299
6,745,958 B2 * 6/2004 Lei ..... 239/585.2
6,810,857 B2 * 11/2004 Boehland et al. ..... 123/467
6,845,926 B2 * 1/2005 Lei ..... 239/533.2

* cited by examiner

*Primary Examiner*—Kevin Shaver
*Assistant Examiner*—Trevor McGraw
(74) *Attorney, Agent, or Firm*—Ronald E. Greigg

(57) ABSTRACT

A fuel injector in injection systems for internal combustion engines having a valve body containing a control chamber that can be pressure-relieved and can be acted on with fuel via an inlet throttle and can be pressure-relieved via an outlet throttle. A first actuator can actuate a closing element. The valve body is connected to a holding body that has a nozzle body connected to it, which encompasses an injection valve element. In order to relieve the pressure in the control chamber, an additional, second outlet throttle is provided, whose closing element can be actuated either by an additional actuator or as a function of the power supply to a double-switching actuator.

28 Claims, 9 Drawing Sheets

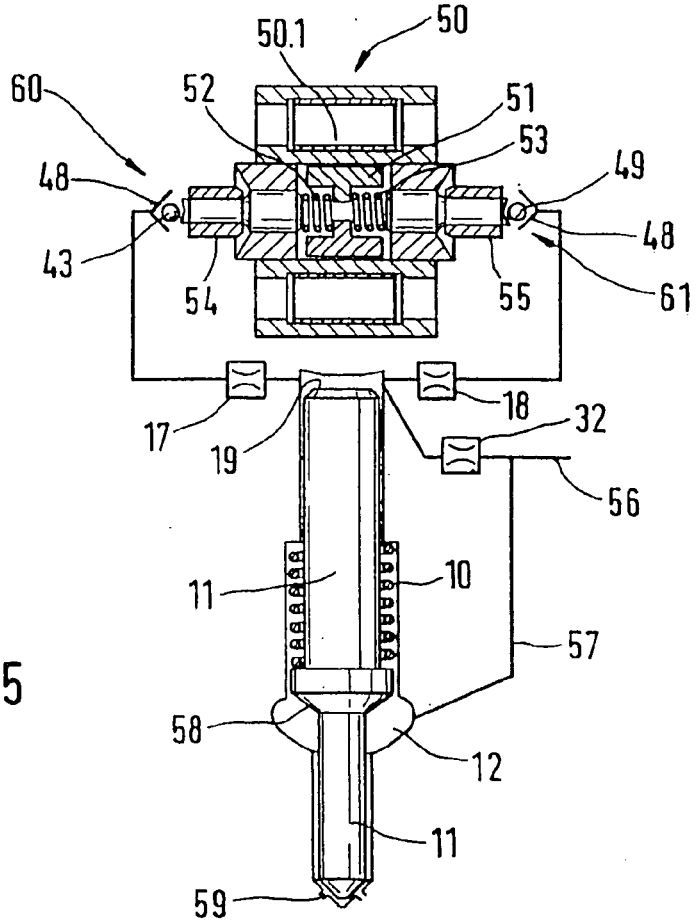
Fig.5
Fig.6.1
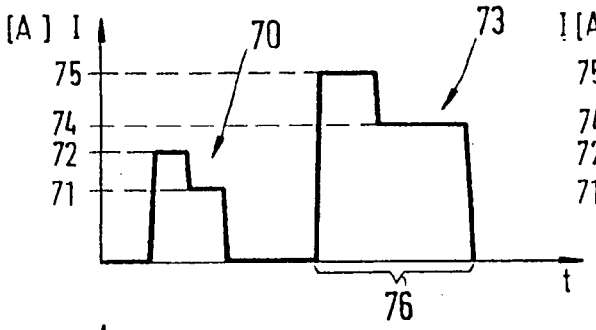
Fig.6.3
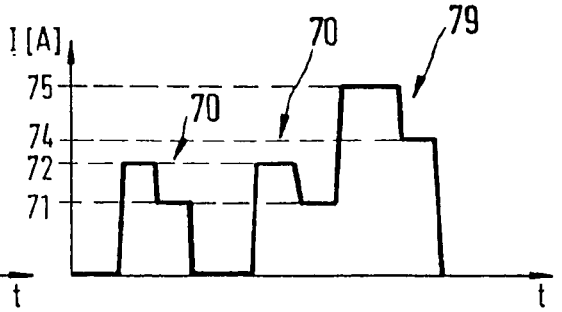
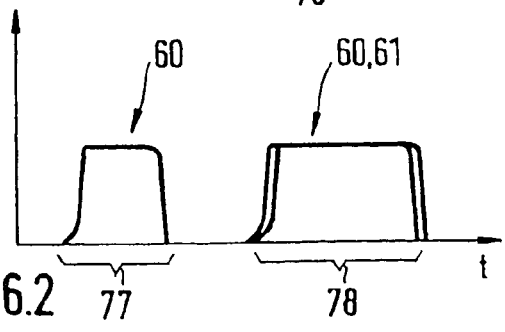
Fig.6.2
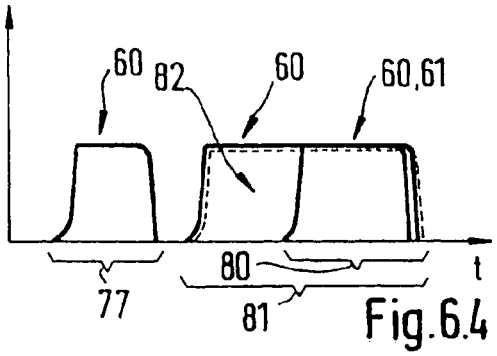
Fig.6.4

FUEL INJECTOR WITH AND WITHOUT PRESSURE AMPIFICATION WITH A CONTROLLABLE NEEDLE SPEED AND METHOD FOR THE CONTROLLING THEREOF

CROSS-REFERENCE TO RELATED APPLICATIONS

This application is a 35 USC 371 application of PCT/DE 03/02317 filed on Jul. 10, 2003.

BACKGROUND OF THE INVENTION

1. Field of the Invention

Fuel injectors of internal combustion engines execute a stroke-controlled or pressure-controlled injection of highly pressurized fuel into the combustion chamber of an engine. In order to comply with current and future exhaust regulations for internal combustion engines, it has become necessary to execute multiple injections (preinjections, main injections, and secondary injections). The time interval between these individual injections should be as short as possible and should at the same time exert as little influence as possible on the subsequent injection. A pilot injection, which precedes the main injection phase and is intended for conditioning the combustion chamber should not influence a subsequent main injection phase with regard to the pressure increase relevant to emissions.

2. Prior Art

The subject of DE 196 50 865 A1 is a solenoid valve for controlling the fuel pressure in the control pressure chamber of an injection valve element, for example in common rail injection systems. The fuel pressure in the control pressure chamber is used to control the movement of a valve piston that opens or closes the injection openings of the injection valve. The solenoid has an electromagnet disposed in a housing part, a moving armature, and a control valve element that is moved by the armature, is acted on in the closing direction by a closing spring, and cooperates with a valve seat of the solenoid valve, thus controlling the flow of fuel out of the control pressure chamber. DE 197 08 104 A1 has also disclosed a solenoid valve of this kind for controlling the fuel pressure in the control pressure chamber of an injection valve.

In order to avoid the disadvantageous armature chatter that occurs in solenoid valves when they are triggered, the armatures of the solenoid valves according to DE 196 50 865 A1 and DE 197 08 104 A1 are embodied as two-part armatures. The armatures have an armature rod and an armature plate that is mounted in sliding fashion onto the armature rod. The use of two-part armatures reduces their effectively braked mass and therefore reduces the kinetic energy of the armature striking the valve seat and thus causing the armature chatter. A triggering of the solenoid valve only results in a definite injection quantity once the postoscillation of the armature plate has finished. It is therefore necessary to take steps to reduce the postoscillation of the armature plate. This is particularly necessary when short time intervals are required between a preinjection and main injection phase. In order to solve this problem, damping devices are used, which have a stationary part and a part that moves with the armature plate. The stationary part can be comprised of a maximum stroke stop, which limits the maximum travel length by which the armature plate can slide on the armature rod. The moving part is comprised of a protrusion that is provided on an armature plate and is oriented toward the stationary part. The maximum stroke stop can be constituted by the end surface of a sliding piece that guides the armature rod and is clamped in a stationary fashion in the housing of the solenoid valve or by a part such as a washer disposed in front of the sliding piece. When the armature plate approaches the maximum stroke stop, a hydraulic damping chamber is formed between the opposing end surfaces of the armature plate and the maximum stroke stop. The fuel contained in the damping chamber exerts a force that counteracts the movement of the armature plate, thus exerting a powerful damping action on the postoscillation of the armature plate.

The disadvantage of the solenoid valves according to DE 196 50 865 A1 and DE 197 08 104 A1 is the precise adjustment of the maximum sliding travel available to the armature plate on the armature rod. The maximum sliding travel, also referred to as maximum stroke, is adjusted by changing the maximum stroke washer, by adding spacers, or by machining down the maximum stroke stop. Since they require an iterative adjustment that must be carried out in steps, these embodiments are costly, are difficult to automate, and therefore extend the cycle times that the manufacture of such solenoid valves requires.

Stroke-controlled fuel injectors in current use for high-pressure injection systems with a high-pressure reservoir each have a throttle and an actuator that can be embodied as a magnet coil or as a piezoelectric actuator. These components, however, only permit the achievement of very low opening and closing speeds of an injection valve element, which can be embodied as a nozzle needle. In multiple injections, it is therefore not possible to use different needle opening speeds to influence the pressure increase, which is decisive with regard to emissions, in such a way that a pilot injection (PI) occurs very close to the main injection phase without influencing the subsequent injections in a functionally critical manner.

SUMMARY OF THE INVENTION

The design according to the invention permits the pressure in a control chamber, which is provided in the fuel injector for actuation of the injection valve element, to be relieved via two outlet throttles. In the design according to the invention, the two outlet throttles that relieve the pressure in the control chamber, which actuates the injection valve element, can be triggered individually or jointly.

In a first embodiment of the design according to the invention, the valve body can be associated with two control elements that function as actuators. One of the solenoid valves that are used as actuators can open a very small outlet throttle for a pilot injection of fuel into the combustion chamber of an autoignition internal combustion engine. The pressure oscillations produced can be kept very low by means of the quantity that the very small outlet throttle allows to flow out of the injection system comprised of the high-pressure reservoir (common rail), the supply line, and the fuel injector. The smaller these pressure oscillations can be kept, the less influence the pressure oscillations have on the possible second pilot injection or the main injection phase following the pilot injection. This gives subsequent injections a significantly greater cyclical stability with regard to the pressure increase and significantly improves the maintenance of extremely small quantities injected into the combustion chamber, i.e. the minimum quantity capacity of the fuel injector according to the invention.

Depending on the way in which the first outlet throttle and an additional, second outlet throttle are matched to each other, the second actuator embodied as a solenoid valve can be used only for the main injection or also together with the actuator that produces the pilot injection and triggers the first outlet throttle, which is very small. When both actuators are triggered, control chamber volumes can be used to relieve the pressure in the control chamber very quickly. This means that the vertical stroke motion of the injection valve element of occurs at a relatively high speed due to the pressure relief of the control chamber. A rapid opening of the injection valve element, which is embodied for example as a nozzle needle, results in the fact that during main injection phases, the jet-preparation energy does not experience any throttling action at the nozzle needle seat due to an excessively slow opening; instead, the jet-preparation energy is present at the injection opening. This means that on the one hand, the fuel injected through the injection openings into the combustion chamber of the engine enters the injection opening at a very high pressure due to the lack of throttling action and on the other hand, the fuel can be very finely vaporized, which has a favorable effect on combustion.

In another embodiment of the design proposed according to the invention, a double-switching solenoid valve can be used instead of two actuators in the form of two solenoid valves that are separately incorporated into the valve body and must be separately triggered. The different intensities of power supplied to the double-switching solenoid valve that is used as the actuator allow the double-switching solenoid valve to be connected to various outlet throttle combinations in order to achieve two different speed levels for the opening movement of the injection valve element, which is preferably embodied as a nozzle needle. Also according to this embodiment, the control chamber that actuates the injection valve element inside a valve body of the fuel injector is provided with two outlet throttles. If the double-switching solenoid valve is triggered with a first, lower current level, then a closing element, which closes an outlet throttle element, is released and a control volume is diverted via this outlet throttle. But if a second power supply level is triggered, which is higher than the first power supply level, then the double-switching solenoid valve opens both outlet throttles.

If the double-switching solenoid valve is triggered with a first power supply level, then a small preinjection quantity can be metered in a precise, stable fashion. If the double-switching solenoid valve is acted on with a second power supply level, though, then a rapid relief of the pressure in the control chamber can occur so that the main injection takes place at a high needle opening speed, with the attendant advantages outlined above.

In other advantageous embodiments of the invention, a pressure booster is also provided, which boosts the fuel pressure above the pressure prevailing in the high-pressure reservoir. This yields numerous additional possibilities for controlling the fuel injector. It offers the possibility of producing different speeds of the nozzle needle with a pressure boosting that can be switched during operation. This wide variability in the control of the fuel injector offers the particular advantage of the capacity to influence the movement sequence of the nozzle needle and to control the injection pressure so that it is possible to shape the injection curve by means of the triggering concept. In comparison to conventionally designed fuel injectors, the fuel injector embodied according to the invention allows for considerably more design freedom with regard to the flexibility of the injection curve and the injection pressure. In addition, it is possible to achieve a very high speed of the nozzle needle during the opening movement.

These embodiments of the invention therefore offer the possibility of an even wider variation in the speed of the nozzle needle of the fuel injector and the possibility of producing a very high injection pressure that exceeds the pressure level of a pressure reservoir even further. The high speed of the nozzle needle reduces the throttling action in the nozzle seat. Both effects lead to a very fine, uniform vaporization of fuel during the injection process and therefore to a further reduction in the emission of pollutant exhaust. Through corresponding control of the magnetic actuators, it is also easily possible to optimally adapt the curve of the injection process to the requirements of the internal combustion engine.

BRIEF DESCRIPTION OF THE DRAWINGS

The invention will be explained in detail below in conjunction with the drawings, in which:

FIG. 5 shows another exemplary embodiment of the fuel injector proposed according to the invention, with a double-switching solenoid valve, FIG. 6.1 shows a first power supply curve for executing a pilot injection and a slowly triggered nozzle needle, and a second power supply curve of a main injection with a triggered nozzle needle, FIG. 6.2 shows the valve strokes that occur according to power supply curves in FIG. 6.1, plotted over the time axis, FIG. 6.3 shows a first power supply curve for a pilot injection and a slowly moved nozzle needle, a second power supply curve for an additional pilot injection and a slow nozzle needle speed, and a main injection with a rapidly triggered nozzle needle, FIG. 6.4 shows the valve strokes occurring with the power supply according to FIG. 6.3.

DESCRIPTION OF THE PREFERRED EMBODIMENTS

Figure 1:
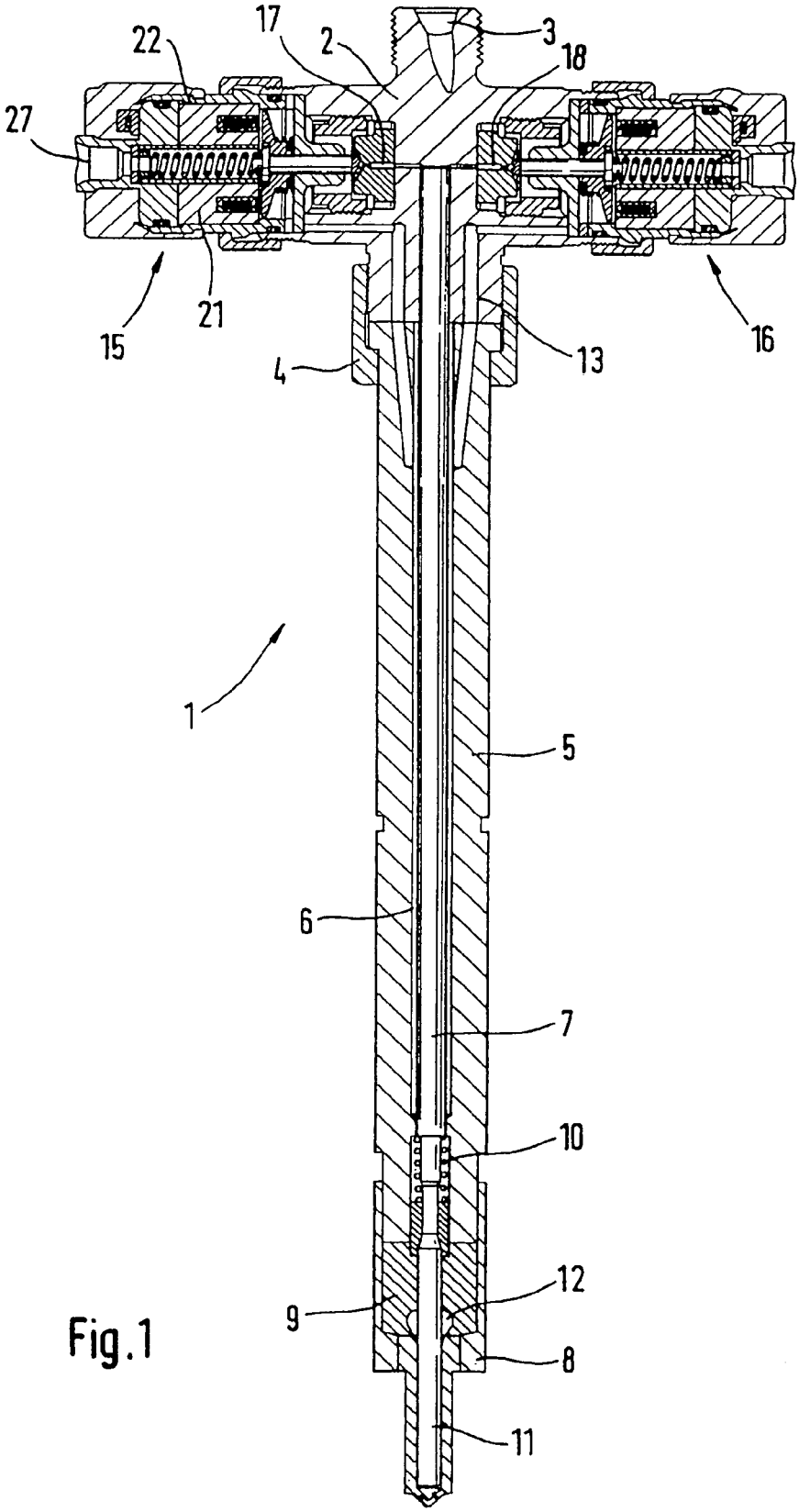
FIG. 1 shows a longitudinal section through a first exemplary embodiment of the fuel injector according to the invention.

FIG. 1 shows a fuel injector 1, which has a valve body 2 to which a holding body 5 is fastened by means of a clamping nut 4. The holding body 5 has a central bore 6 that contains a push rod 7 that extends in the valve body 2 and through the holding body 5. The lower end of the holding body 5, which is interchangeably fastened to the valve body 2 by means of the clamping nut 4, accommodates a nozzle retaining nut 8, which in turn contains a nozzle body 9. The nozzle retaining nut 8 serves to screw the lower end of the holding body 5 to the nozzle body 9. The transition region between the lower end of the holding body 5 and the upper region of the nozzle body 9 contains a closing spring 10, which encompasses the lower end of the push rod 7 and acts on a vertically moving injection valve element 11 contained in the nozzle body 9. The injection valve element 11 is preferably embodied as a nozzle needle and, in the region of a pressure shoulder, is encompassed by nozzle chamber 12.

In the lower region of the valve body 2, facing the upper region of the holding body 5, leakage bores 13 extend through the valve body 2 and the holding body 5. The leakage bores 13 serve as a leakage outlet via an armature rod guide 46 that is integrated into the valve body 2 and shown in detail in FIG. 4*a*.

Figure 4:
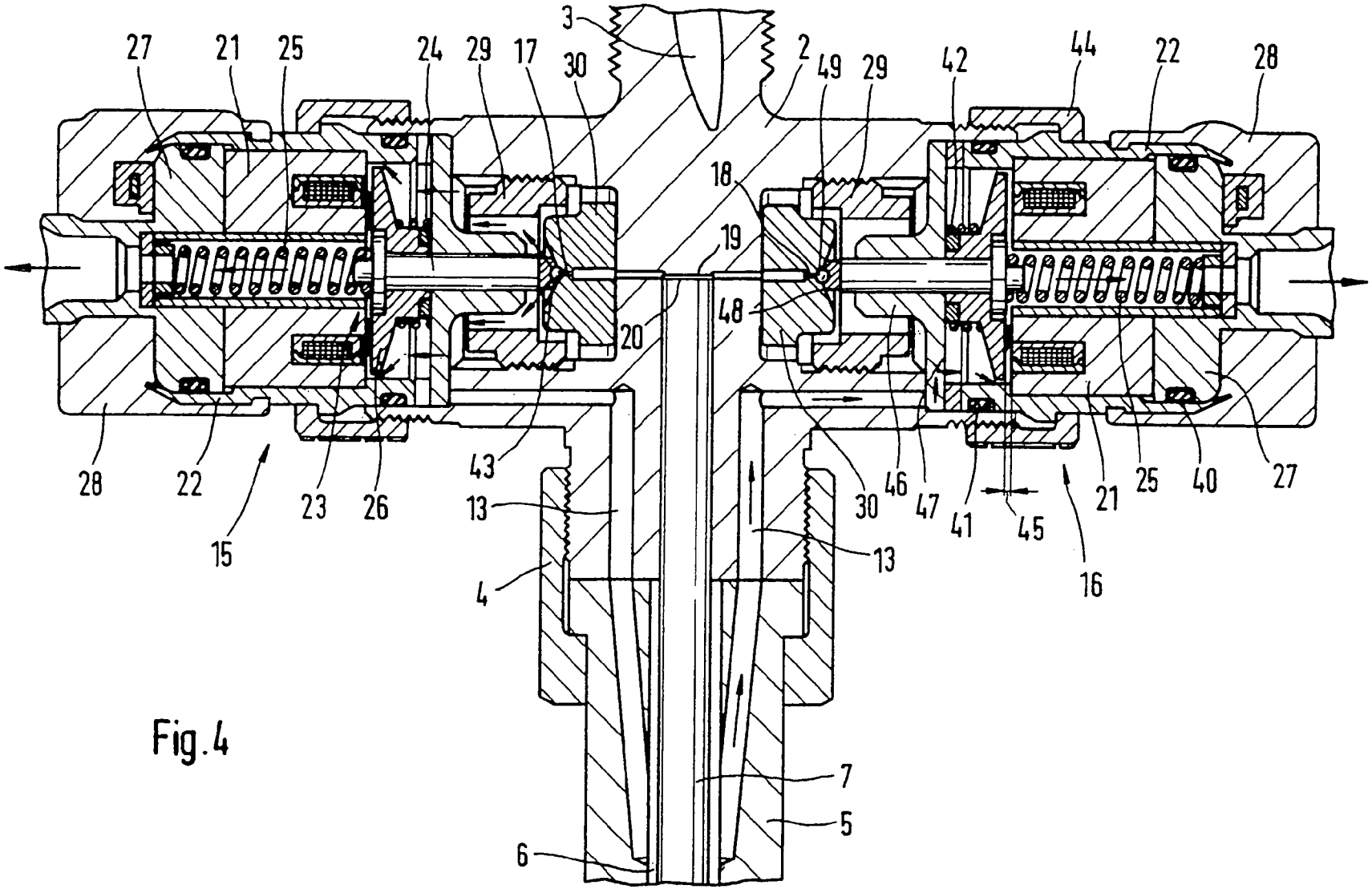
FIG. 4 shows an enlargement of the valve body of the fuel injector according to the invention in the first exemplary embodiment.

In its upper region, the valve body 2 has an inlet fitting 3. To the sides in the depiction according to FIG. 1, a first actuator 15 and a second actuator 16 are screwed into corresponding bores in the valve body 2. In the first exemplary embodiment of the design according to the invention shown in FIG. 1, two separate actuators 15 and 16 are provided, which are preferably embodied as solenoid valves. The first actuator 15 acts on a first outlet throttle 17 (see FIG. 4) while the second actuator 16 acts on a triggering throttle element 18 disposed opposite from it. The two outlet throttles 17 and 18 shown in FIG. 4 are opened and closed by a for example spherical or conical closing body (see depiction in FIG. 4). The valve body 2 also contains a control chamber 19 that is delimited on the one hand by the valve body 2 and on the other hand by the upper end surface of the push rod 7. The first actuator 15 and the second actuator 16 are structurally identical. The first actuator 15 has a magnet core 21 that is encompassed by a cylindrical magnet sleeve 22. The magnet coil contained in the magnet core 21 actuates a solenoid armature (see depiction in FIG. 4). The solenoid armature is acted on by a compression spring 25 that extends through the magnet core 21 and is partially encompassed by a plate-shaped region of an outlet fitting 27. The second actuator 16 is embodied in an analogous fashion.

Figure 2:
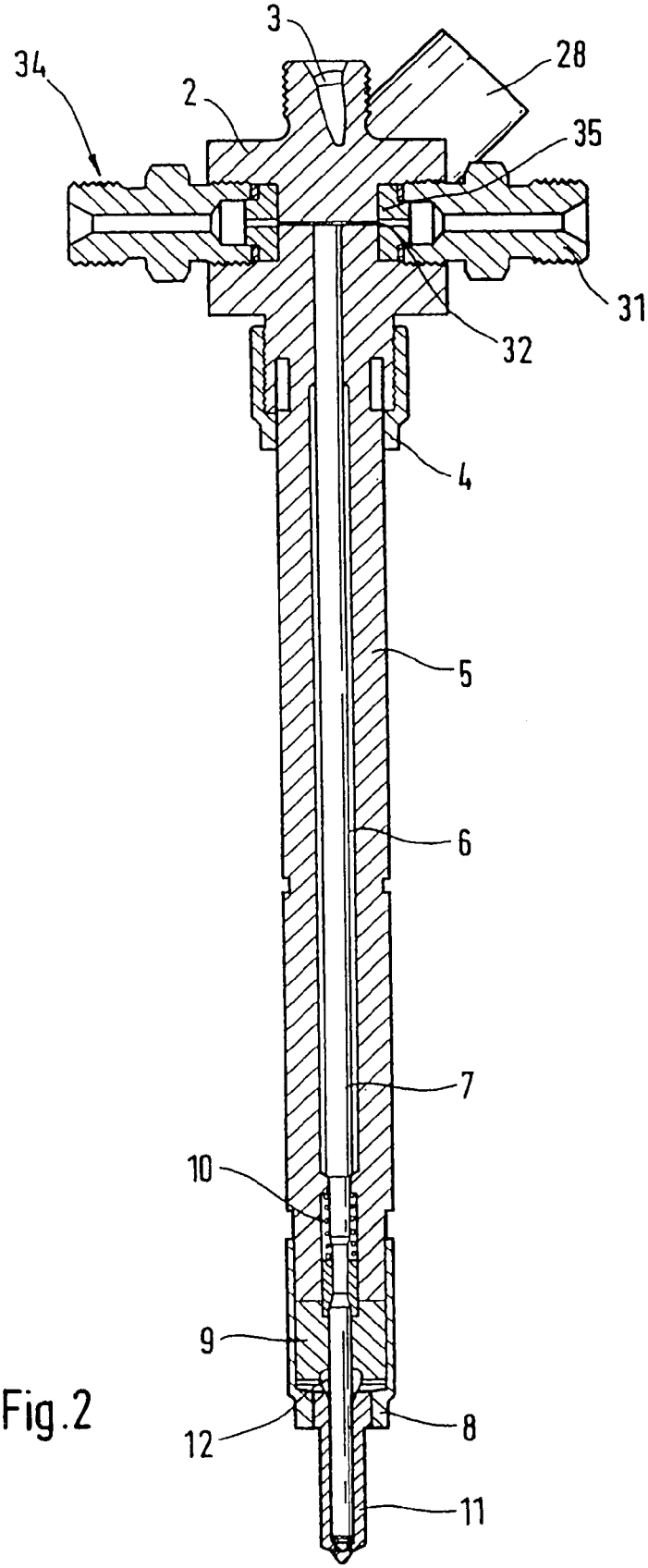
FIG. 2 shows the exemplary embodiment of a fuel injector according to FIG. 1, but in a position that is rotated by 90° in relation to FIG. 1.

FIG. 2 shows the first exemplary embodiment of the fuel injector embodied according to the invention, but in a position that is rotated by 90° in relation to FIG. 1.

FIG. 2 shows that the valve body 2, whose upper region has a central bore connection 3, has a pressure connection fitting 31 in addition to the first and second actuators 15 and 16 shown in FIG. 1. This pressure connection fitting 31, which is screwed into the valve body 2, has an inlet throttle 32 via which a control volume, i.e. highly pressurized fuel, is exerted on the control chamber 19 (see FIG. 4*a*). The pressure fitting opposite from the pressure connection fitting 31 can be used as a pressure measurement connection 34 for measuring the level of pressure prevailing in the control chamber 19. At the bottom end of the valve body 2, a clamping nut 4 is shown, which connects the holding body 5 to the valve body 2. The screw connection by means of the clamping nut 4 between the valve body 2 and the holding body 5 permits the fuel injector according to the invention to be embodied in various lengths. This advantageously permits the geometry of the valve body 2 to remain unchanged and the length to be adapted solely by means of the height, i.e. the axial length of the holding body 5.

At the bottom end of the holding body 5, a nozzle retaining nut 8 holds the nozzle body 9, which in turn contains a vertically moving injection valve element 11.

Figure 3:
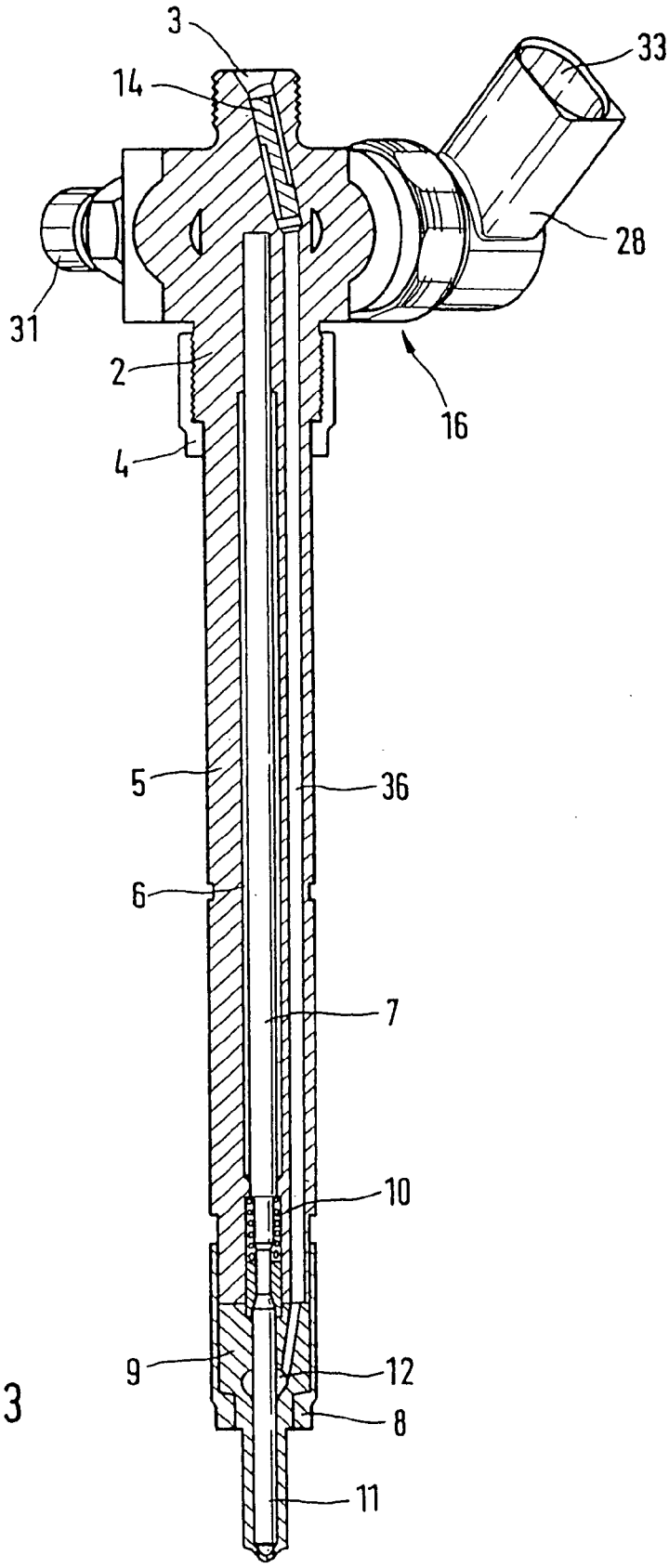
FIG. 3 shows the longitudinal section through a fuel injector embodied according to the invention from FIG. 1, rotated slightly into the plane containing the nozzle chamber inlet bore.

FIG. 3 shows the first exemplary embodiment of the fuel injector according to the invention, rotated into a plane containing the central bore 36 that acts on the nozzle chamber in the nozzle body.

FIG. 3 shows a filter rod element 14 inserted into the inlet fitting. Below the filter rod 14, the central bore 36 extends through the valve body 2 and feeds into the holding body 5 at the butt joint at the lower end of the valve body 2. The central bore 36 supplies highly pressurized fuel to the nozzle chamber 12 encompassing the injection valve element 11 inside the nozzle body 9. The pressure connection fitting 31 and a housing 28 disposed on the second actuator 16 are mounted onto the sides of the valve body 2. The second actuator 16 also includes a housing 28 provided with a plug connection 33. The plug connection 33 on the housing 28 serves to supply power to the magnet coils encompassing the magnet core 21 in each of the two actuators 15 and 16.

The valve body 2 according to the depiction in FIG. 4 includes a centrally disposed high-pressure inlet 3. On the end opposite from the high-pressure inlet 3, the lower region of the valve body 2 has a clamping nut 4 that fastens an interchangeable holding body 5 to the valve body 2. In its lower region, the valve body 2 has leakage bores 13, which serve as a leakage outlet. A leakage outlet is required in order to convey control chamber volume (leakage flow II) diverted from the opened outlet throttles 17 and 18 via bores embodied in the armature rod guide 46, through an armature rod, around the armature plate 26, and into the outlet fitting 27. In addition, leakage that flows out of the nozzle (leakage flow I) is conveyed from the bore extending through the holding body 5 to the bore extending at right angles through the valve body 2 and then likewise via the armature rod guide 46 to the outlet fitting 27 (see arrows in FIG. 4).

Both the valve body 2 and the holding body 5 have a central bore 6 that encompasses a rod-shaped thrust element 7 in the depiction according to FIG. 4. The end surface 20 of the rod-shaped thrust element 7 delimits a control chamber 19 inside the valve body 2 (see FIG. 1*a*). The control chamber 19 inside the valve body 2 is also delimited by the housing of the valve body 2 in addition to the end surface 20 of the rod-shaped thrust element 7. The control chamber 19 inside the valve body 2 has two opposing outlet conduits branching from it, which respectively transition into a first outlet throttle 17 and a second outlet throttle 18. The two conduits acting on the outlet throttles 17 and 18 are disposed on opposite sides from each other inside the valve body 2.

Each of the outlet throttles, i.e. the first outlet throttle 17 and the second outlet throttle 18, is embodied in an insert piece 30. The insert pieces 30 are disposed opposite from each other inside the valve body 2 and are held in place in the valve body 2 by means of valve clamping screws 29.

Each of the outlet throttles 17 and 18 is associated with a respective closing element 43 or 49 that can be embodied in the form of a spherical closing element, as shown in FIG. 4. Instead of spherical closing elements 43 and 49, the closing elements actuated by the first actuator 15 and the second actuator 16 can also be embodied in the form of conical closing bodies. Then they each cooperate with a respective conical seat embodied on the side of the insert 30 oriented toward the closing element 43 or 49, which insert 30 is interchangeably accommodated in the valve body 2. The first actuator 15 and the second actuator 16 perform the actuation, i.e. the opening and closing of the first outlet throttle 17 and the second outlet throttle 18. Each of the actuators 15 and 16, which are accommodated on opposite sides from each other in the valve body 2 of the fuel injector 1, includes a magnet core 21 encompassed by a magnet coil. The magnet core 21 is encompassed by a cylindrical magnet sleeve 22; this magnet sleeve 22 also extends around the lower, plate-shaped projection of an outlet fitting 27. The housing 28, together with a plug connection 33 embodied in it, is snapped onto the outlet fitting 27 and the upper region of the magnet sleeve 22 encompassing the magnet core 21. The magnet sleeve 22 has an annular shoulder at the level of which it is encompassed by a magnet clamping nut 44 that can screw-connect the first actuator 15 and the second actuator 16 to an external thread of the valve body 2 of the fuel injector 1.

The respective magnet core 21 of the first actuator 15 and the second actuator 16 encompasses a compression spring 25 that is in turn encompassed by a sleeve. The compression spring 25 acts on a solenoid armature 23, which includes an armature rod 24 and has an armature plate 26 that encompasses the armature rod 24. The armature rods 24 of the solenoid armatures of the first actuator 15 and the second actuator 16, at their end surfaces oriented toward the closing elements 43 and 49, have closing element recesses that partially encompass the closing elements 43, 49 in accordance with their geometry.

The plate-shaped region of the outlet fitting 27 is provided with a first sealing ring 40, which is oriented toward the inside of the magnet sleeve 22 encompassing the magnet core 21. On the outside, the magnet sleeve 22 has another, second sealing ring 41. When the first actuator 15 and second actuator 16 are embodied as solenoid valves, the solenoid armature 24, 26 can include an armature plate spring 42 that supports the armature plate 26 of the solenoid armature 24, 26 in relation to an armature rod guide 46 that encompasses the armature rod 24. The reference numeral 45 indicates the stroke that the solenoid valve executes when the magnet coil contained in the magnet core 21 is supplied with power. The armature stroke 45 is the distance between the end surface of the armature plate 26 oriented toward the magnet coil inside the magnet core 21 and the end surface of the magnet core 21 oriented toward this armature plate. The armature plate spring 42 acting on the armature plate 26 of the solenoid armature 24, 26 is supported against an end surface 47 of the armature rod guide 46. According to the embodiment of the valve body 2 of the fuel injector 1 shown in the enlargement in FIG. 4, the outlet throttles 17 and 18 are embodied in interchangeable inserts 30. The inserts 30 can be laterally mounted—as shown in FIG. 4—by means of valve clamping nuts 29 on opposite sides from each other in corresponding bores in the valve body 2. In addition, it would also be possible to affix the inserts 30 in the valve body 2 directly by means of the first actuator 15 and the second actuator 16.

The inlet throttle 32, which is not shown in FIG. 4 and acts on the control chamber 19 with a control volume (see depiction in FIG. 2), extends perpendicular to the plane of the drawing and is disposed in a position that is oriented rotated by 90° in relation to the conduits of the control chamber 19 that act on the outlet throttles 17 and 18. The central high-pressure fitting 3 shown in the upper region of the valve body 2 transitions into an inlet bore 36 not shown in FIG. 4 that extends essentially parallel to the central bore 6 in the holding body 5 and the valve body 2.

The attachment of the holding body 5 to the lower end of the valve body 2 by means of a clamping nut 4 makes it possible to take into account different engine installation lengths of the fuel injector 1 embodied according to the invention. Without having to modify the relatively complex valve body 2 of the fuel injector 1, once the clamping nut 4 between the holding body 5 and the valve body 2 is loosened, a holding body 5 with a matching installation length can be attached to the valve body 2 by means of the clamping nut 4. At the lower end of the holding body 5—not shown in FIG. 4—a nozzle retaining nut 8 holds a nozzle body 9, which contains a vertically moving injection valve element 11 embodied, for example, in the form of a nozzle needle. A closing spring 10 can act on the injection valve element 11 (see depictions in FIGS. 1 to 3). The nozzle chamber 12 encompassing the injection valve element 11 inside the nozzle body 9 is acted on with highly pressurized fuel via the inlet bore 36 extending essentially parallel to the central bore 6 in the holding body 5.

The first actuator 15 and the second actuator 16 can relieve the pressure in the control chamber 19. In order to execute a pilot injection with a fuel injector 1, the first outlet throttle 17 in the corresponding insert 30 can be embodied with a very small cross-section. If the first actuator 15 is triggered, then the pressure in the control chamber 19 inside the valve body 2 is relieved only via the first outlet throttle 17. The small outlet quantity makes it possible to keep pressure oscillations very low. Because the pressure oscillations are small in amplitude, they do not have a negative impact on subsequent injections. The main injection can therefore be kept cyclically stable; the small dimensions given to the first outlet throttle 17 can significantly improve the minimum quantity capacity of the fuel injector 1. Depending on the matching of the outlet throttle cross sections of the outlet throttles 17 and 18, the second actuator 16 can be triggered either together with the first actuator 15 or separately from it. When the first actuator 15 and the second actuator 16 are triggered at the same time, the pressure in the control chamber 19 inside the valve body 2 is relieved via both of the outlet throttles 17 and 18. This permits very rapid relief of the pressure in the control chamber 19, which results in a higher opening speed of the injection valve element 11. Because of this, during main injections, no throttling of the jet-preparation energy occurs at the seat of the injection valve element 11; instead, the jet-preparation energy is present at the injection opening(s) of the fuel injector 1 leading into the combustion chamber of an autoignition internal combustion engine.

Figure 4A:
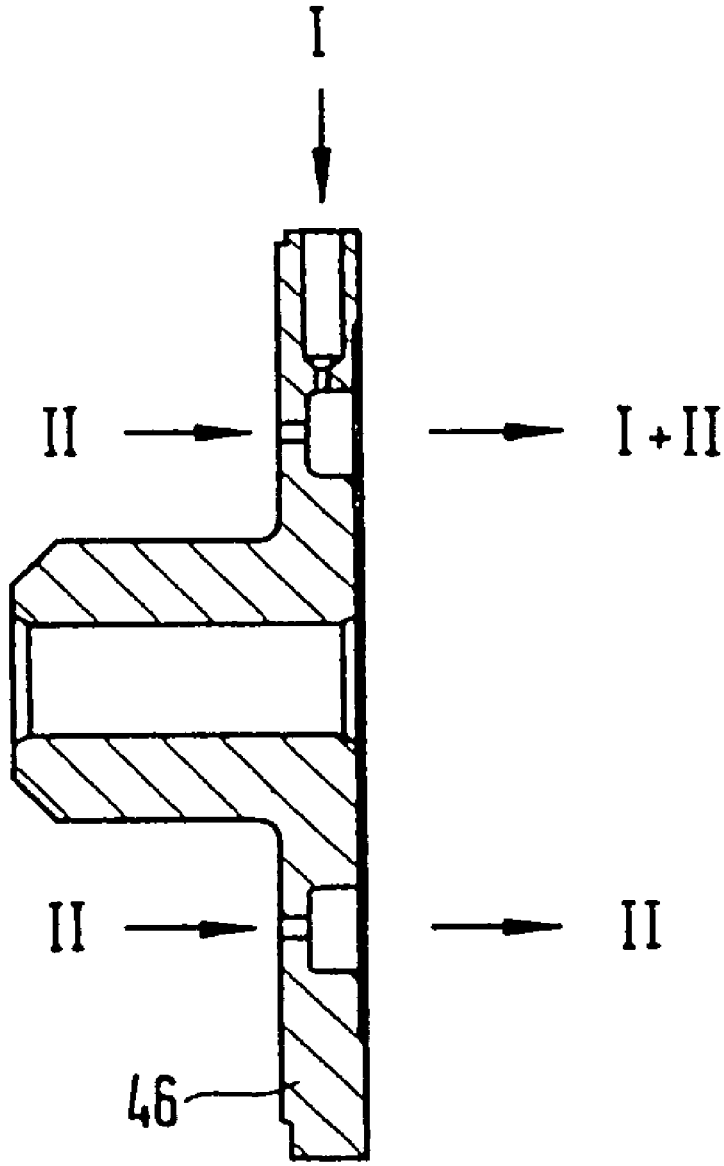
FIG. 4*a* shows an enlargement of an armature rod guide, which is contained in the valve body 2.

The depiction according to FIG. 4*a* shows the armature rod guide 46 in an enlarged scale. The leakage flow labeled I represents the leakage flow traveling from the nozzle, through the holding body 5 and the bore section extending at right angles inside the valve body 2, into the outlet fitting 27, while II indicates the leakage volume flow traveling out of the control chamber 19 through the open outlet throttles 17 and 18. To this end, the armature rod guide 46 encompassing the armature rod 24 of the solenoid armature can be provided with bores extending in a disk-shaped region and bore sections extending radially in relation to these so that the leakage flows I and II can take the flow paths indicated by the arrows in FIG. 4; the leakage flows I and II always exit the valve body 2 of the fuel injection valve 1 according to the depiction in FIG. 4 via the outlet fitting 27.

FIG. 5 shows a double-switching solenoid valve, which can be used in the fuel injector according to the invention depicted in FIGS. 1 to 4.

According to the second exemplary embodiment of the concept underlying the invention, instead of two separately controllable actuators 15 and 16, a double-switching actuator 50 can be used. The double-switching actuator 50 can be embodied as a piezoelectric actuator or as a solenoid valve.

When the double-switching actuator 50 is embodied as a solenoid valve, it has a magnet coil 50.1 that produces different opening speeds of the injection valve element 11 when it is supplied with different levels of current. FIG. 5 schematically depicts the design of the fuel injector with a double-switching solenoid valve 50. The components of the nozzle, holding body 5, and push rod 7 are identical to those in the first embodiment mentioned. Analogous to the depiction of the first embodiment of the fuel injector 1 according to the invention shown in FIGS. 1 to 4, the pressure in the control chamber 19 is relieved via a first outlet throttle 17 and an additional, second outlet throttle 18. The control chamber 19 is acted on with highly pressurized fuel via an inlet throttle 32, which is in turn acted on via a high-pressure connection 56. Upstream of the inlet throttle 32, an inlet bore 57 branches off to the nozzle chamber 12, which encompasses the injection valve element 11 that is embodied in the form of a nozzle needle. A closing spring 10 acts on the injection valve element 11, which has a pressure step 58 that protrudes into the nozzle chamber 12. At the end of the injection valve element 11 oriented toward the combustion chamber, injection openings 59 are shown, through which the highly pressurized fuel can be injected into the combustion chamber of an internal combustion engine with autoignition or externally supplied ignition.

When the double-switching actuator 50 is embodied as a double-switching solenoid valve, it includes a magnet coil 50.1. A first compression spring 52 and an additional, second compression spring 53 are supported against a support ring 51 encompassed by the magnet coil 50.1. The first compression spring 52 acts on a first armature rod 54, while the second compression spring 53 supported against the support ring 51 acts on a second armature rod 55. The armature rods 54 and 55 according to the second exemplary embodiment of the fuel injector 1 correspond to the armature rods 24 of the solenoid armatures 24, 26 according to the first exemplary embodiment of the fuel injector 1 according to FIG. 4. The double-switching actuator 50 can actuate a first valve 60 and a second valve 61. The different opening and closing of the solenoid armatures or solenoid armature rods 54 and 55 in the double-switching actuator 50 can be the result of different spring forces on the one hand and different armature geometries on the other. As a result of the different armature geometries, the respectively achievable magnetic forces change as the armature geometry changes. When the magnet coil 50.1 is supplied with a first power supply level, for example the first valve 60 opens and permits the pressure in the control chamber 19 to be relieved via the first outlet throttle 17. When the power supplied to the magnet coil 50.1 of the double-switching actuator 50 increases, then a simultaneous actuation of the armature rods 54 and 55 occurs so that the first valve 60 and the second valve 61 are opened, thus allowing the pressure in the control chamber 19 to be relieved via both the first outlet throttle 17 and the second outlet throttle 18. The first armature rod 54 and the second armature rod 55 include closing element guides that are schematically depicted in FIG. 5 and that partially encompass the closing elements 43 and 49 embodied as spherical bodies in the depiction according to FIG. 5. The closing elements 43 and 49 cooperate with seat surfaces 48 that can be embodied in the inserts 30 interchangeably accommodated in the valve body 2 (see depiction according to FIG. 4). Instead of the spherically embodied closing elements 43 and 49 shown in FIG. 5, these can also be embodied as conical bodies that can cooperate with correspondingly embodied seat surfaces in the inserts 30 (see depiction according to FIG. 4).

When the magnet coil 50.1 of the double-switching actuator 50 is supplied with a first current level, one of the two valves 60 and 61 is triggered with a lower spring force or with an increased magnetic force. When the current level with which the magnet coil 50.1 of the double-switching actuator 50 is powered increases to a second current level, then both valves 60 and 61 can be opened so that both outlet throttles 17 and 18 are open and the injection valve element 11 opens at an increased opening speed—possibly before a main injection.

FIGS. 6.1 and 6.2 respectively show power supply curves with the magnet coil of a double-switching actuator and the valve strokes produced.

The magnet coil 50.1 can be powered according to a first power supply curve labeled with the reference numeral 70 so that it actuates the first valve 60, i.e. the first outlet throttle 17, for a triggering period 77. The magnet coil 50.1 is powered during the triggering period 77 in such a way that the magnet coil 50.1 is triggered with a current surge, a current step-up 72, which returns to a first current level 71 after a period of time. As a result, the closing element 43 of the first valve 60 opens during the triggering period 77 of the magnet coil 50.1 with a first current curve 70.

If the magnet coil 50.1 of the double-switching actuator 50 is powered with a second current curve 73, then both the valve 60 and the valve 61 open. Due to the design differences between the valves 60 and 61 in terms of their spring forces and magnetic forces, the valve 61 opens in a time-delayed fashion in comparison to the valve 60 and closes slightly earlier after the power supply is terminated. The second power supply curve 73 is characterized in that at the beginning of the power supply period 76, a current step-up 75 occurs, which returns to a second current level 74 after a certain period of time. The higher current power causes both the first valve 60 and the second valve 61 to open during a common triggering period 78. During the common triggering period 78 caused by the current level of the power supply to the magnet coil 50.1, the pressure in the control chamber 19 is relieved simultaneously via both the first outlet throttle 17 and the second outlet throttle 18.

The depiction according to FIGS. 6.3 and 6.4 compares variants of power supply curves and valve strokes to each other.

FIG. 6.3 shows that a supply of power to the first valve 60 during the triggering period 77 occurs with a first power supply curve 70 analogous to FIG. 6.1. As a result, during the triggering period 77, the first valve 60 travels by a stroke that is identical to the stroke of the first valve 60 according to FIG. 6.2.

According to the depiction in FIG. 6.3, a modified supply of power to the magnet coil 50.1 of the double-switching actuator 50 now occurs in accordance with a third power supply curve 79. The third power supply curve 79 is characterized in that by contrast to the second power supply curve 73 in the depiction according to FIG. 6.1, the second current step-up 75 is preceded by a current pulse that corresponds to the first power supply curve 70. However, this current pulse still occurs at the lower power level so that during the phase of the third power supply curve 79 that corresponds to the first power supply curve 70, the second valve 61 remains closed.

FIG. 6.4 shows the valve strokes of the first valve 60 and the second valve 61 that are produced when power is supplied in accordance with a third power supply curve 79. In the phase of the third power supply curve 79 that corresponds to the first power supply curve 70, the second valve 61 remains closed initially. Only when the third power supply curve 79 has reached the second current step-up 75 does the second valve 61 open in addition to the already open first valve 60. With the third power supply curve 79, it is therefore possible to open the second valve 61, i.e. to open the second outlet throttle 18, in addition to the already open first outlet throttle 17 in order to relieve the pressure in the control chamber 19. During the control period labeled with the reference numeral 81, the second valve 61 is opened after a delay phase 82 so that a quicker relief of the pressure in the control chamber 19 occurs only after the second valve 61 is opened. This chronologically variable opening of the second valve 61 can be used to control the stroke curve of the injection valve element 11 in order to shape the injection curve. It is therefore possible to achieve an intentional delay of the stroke motion of the injection valve element 11.

The following exemplary embodiments of the invention make it possible to vary the speed of the fuel injector nozzle needle even more and to produce a very high injection pressure that exceeds the pressure level of a pressure reservoir by even more. The high speed of the nozzle needle reduces the throttling action in the nozzle seat. Both effects yield a very fine, uniform vaporization of the fuel during the injection process and therefore also yield a further reduction in the emissions of polluting gases. Through appropriate control of the magnetic actuators, it is also easily possible to optimally adapt the curve of the injection process to the needs of the internal combustion engine.

Figure 7:
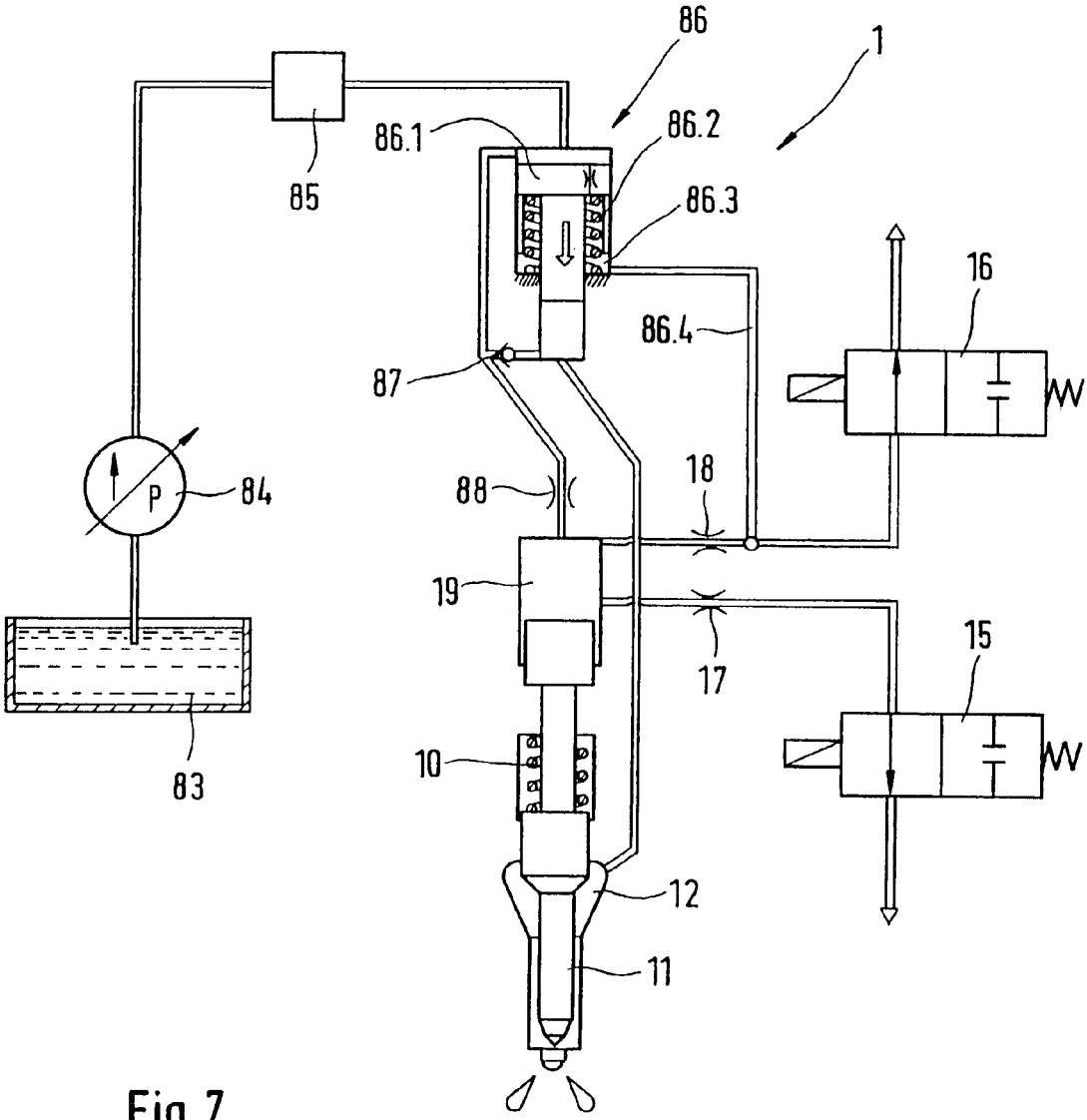
FIG. 7 shows another embodiment of the fuel injector proposed according to the invention, with a pressure booster and two 2/2-way valves serving as actuators.

FIG. 7 shows an advantageous additional embodiment of the fuel injector according to the invention, with a pressure booster and with control of the fuel injector by means of two 2/2-way valves. The fuel injector 1 schematically depicted here is a component of an injection system that also includes a fuel tank 83, a high-pressure pump 84, a pressure reservoir 85, and other fuel injectors not shown here. The fuel injector 1 has a pressure booster 86 with a spring chamber 86.3, a spring 86.2 contained in this spring chamber, and a pressure booster piston 86.1 acted on by the spring 86.2. A check valve 87 and an inlet throttle 88 are also provided. The outlet side of the inlet throttle 88 is connected to the control chamber 19 of the fuel injector 1. The control chamber 19 is connected to a first outlet throttle 17, whose outlet side communicates with a first 2/2-way valve, and to a second outlet throttle 18, whose outlet side communicates with a second 2/2-way valve.

The operation of this first exemplary embodiment will be described below. There are three distinguishable control variants. In a first control variant, the triggering of the first 2/2-way valve 15 opens the first outlet throttle 17 and thus relieves the pressure in the control chamber 19 of the fuel injector 1. The forces acting on the nozzle needle 11 lift it counter to the pressure of the spring 10, thus opening the injection nozzle. An injection occurs at the pressure of the pressure reservoir 85. If the first 2/2-way valve 15 is closed again, then the pressure in the control chamber 19 of the fuel injector 1 increases again, the injection nozzle is closed, and the injection is thus terminated.

In a second control variant, the triggering of the second 2/2-way valve 16 opens the second outlet throttle 18 and also the discharge line of the spring chamber 86.3 of the pressure booster 86. As already explained above in the description of the opening of the first 2/2-way valve 15, on the one hand, this relieves the pressure in the control chamber 19 of the fuel injector 1, the injection valve element 11 is lifted up, and the injection nozzle is opened. However, at the same time, the pressure in the spring chamber 86.3 of the pressure booster 86 is also relieved, as a result of which the piston 86.1 of the pressure booster 86 can start to move counter to the pressure exerted on it by the spring 86.2. This causes a pressure increase on the high-pressure side and the injection occurs at a pressure higher than the one prevailing in the pressure reservoir 85. Actual practice has demonstrated that it is possible to achieve a piston area ratio between the low-pressure side and the high-pressure side of the pressure booster 86 of from approx. 1:1.5 to approx. 1:3. Leaving aside dynamic pressure wave effects, these factors approximately correspond to the pressure increase that can be achieved with the pressure booster 86.

In a third control variant, the first 2/2-way valve 15 and the second 2/2-way valve 16 are triggered simultaneously. This opens the first outlet throttle 17, the second outlet throttle 18, and the discharge line 86.4 of the spring chamber 86.3 of the pressure booster 86 simultaneously. As a result, on the one hand, as already described above, the pressure is relieved in the control chamber 19 of the fuel injector 1. This time, however, this occurs via two outlet throttles 17 and 18. As a result, the injection valve element 11 opens significantly faster. At the same time, the pressure booster 86, as has already been explained above, again produces a significantly higher injection pressure.

Figure 9:
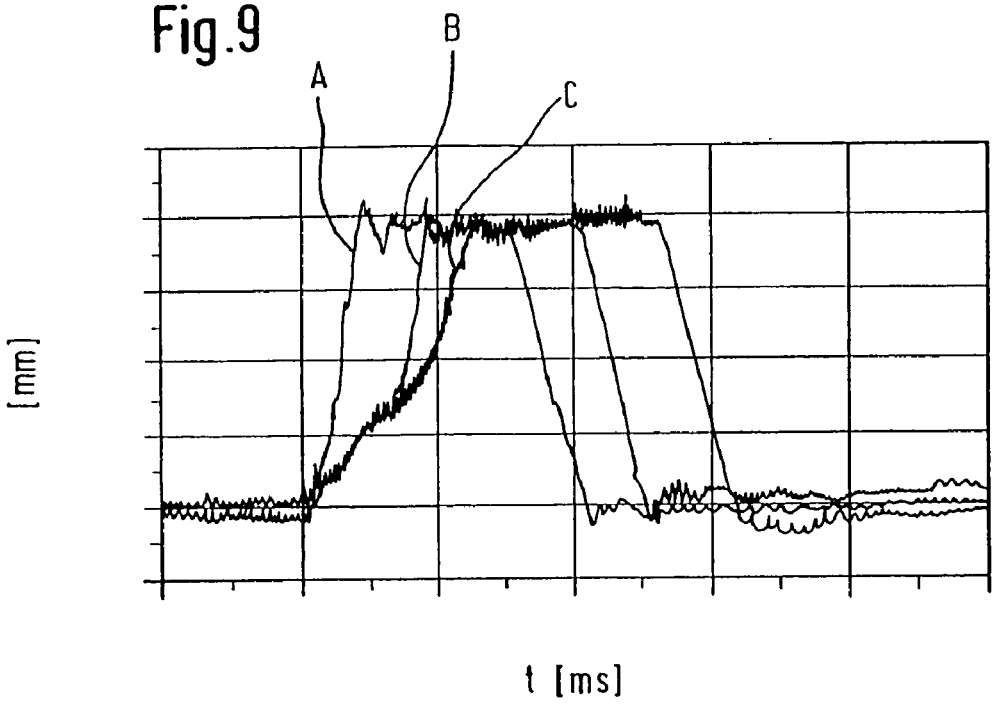
FIG. 9 is a graph depicting the nozzle needle stroke as a function of time.

Three different advantageous control variants have been described above in conjunction with this exemplary embodiment of the invention according to FIG. 7. In actual practice, a wide variation range is achieved by chronologically shifting the triggering times of the first 2/2-way valve 15 and the second 2/2-way valve 16. This makes it possible to influence the opening speed of the injection valve element 11 and the curve of the injection. This will be explained in conjunction with FIG. 9, which shows a graph of the stroke of the injection valve element 11 as a function of time t. Curve A is produced when the first 2/2-way valve 15 and the second 2/2-way valve 16 are triggered at the same time. Curve B is produced when the second 2/2-way valve 16 is triggered slightly later than the first 2/2-way valve 15. Finally, curve C is produced when the second 2/2-way valve 16 is triggered significantly later than the first 2/2-way valve 15.

Figure 10:
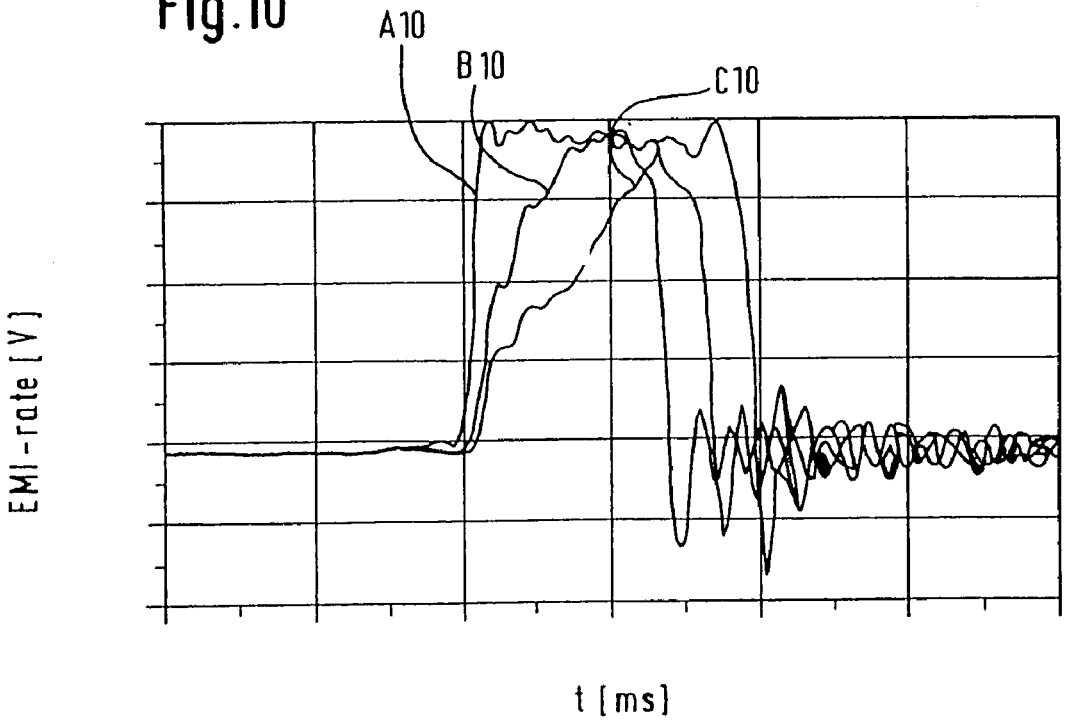
FIG. 10 is another graph depicting the injection as a function of time.

In addition, shifting the triggering onset of the first 2/2-way valve 15 and the second 2/2-way valve 16 advantageously makes it possible to shape the injection curve. This is demonstrated by the graph shown in FIG. 10, which depicts the injection curve as a function of time t. The essentially rectangular progression of curve A10 is produced when the first 2/2-way valve 15 and the second 2/2-way valve 16 are triggered at the same time. If the second 2/2-way valve 16 is triggered slightly later than the first 2/2-way valve 15, this produces the ramp-shaped progression represented by curve B10. Finally, the essentially boot-shaped curve C10 is produced when the second 2/2-way valve 16 is triggered significantly later than the first 2/2-way valve 15. The different progressions of the curves discussed above can be attributed to the beginning of the action of the pressure booster 86.

Figure 8:
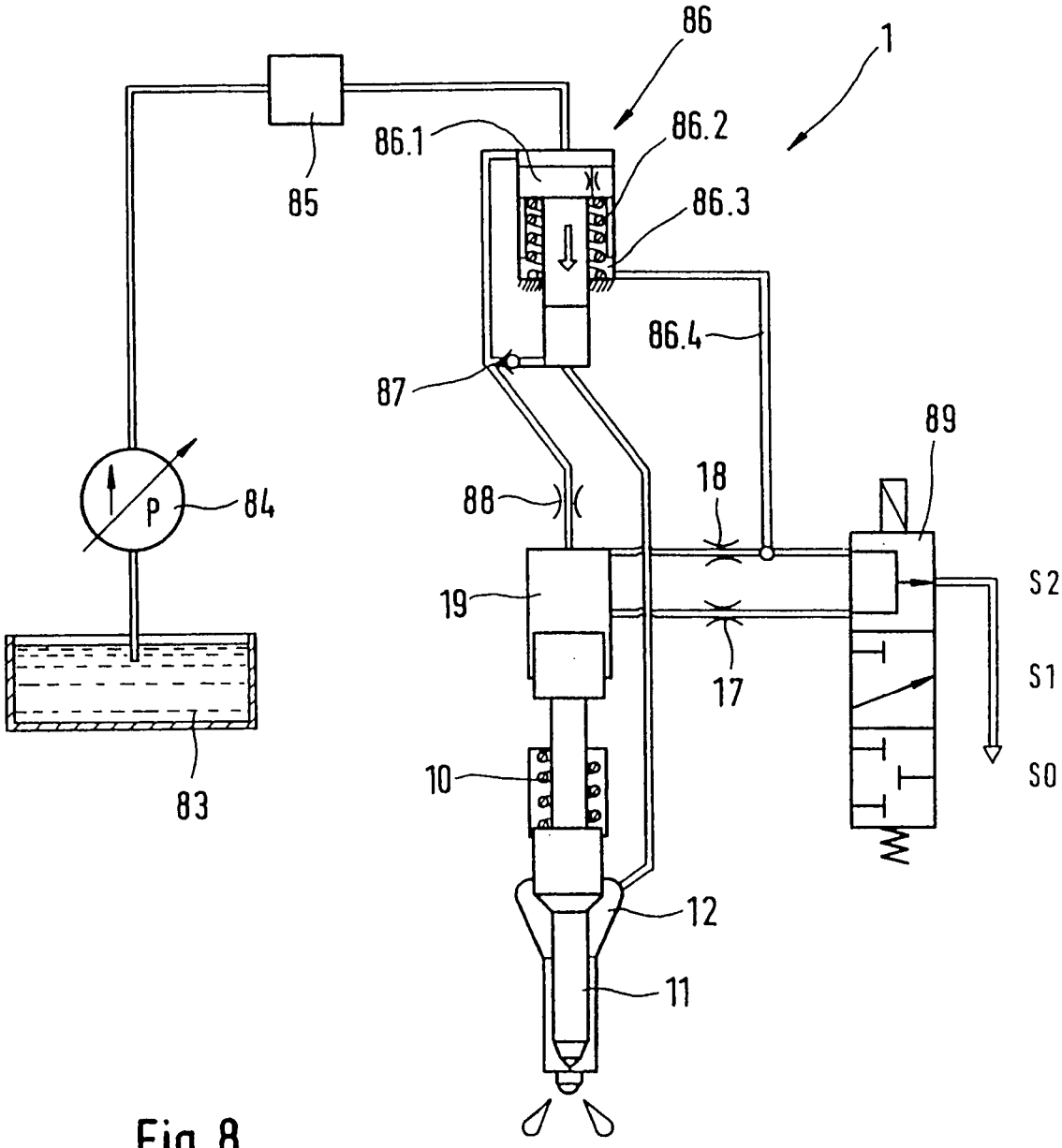
FIG. 8 shows another embodiment of the fuel injector proposed according to the invention, with a pressure booster and a 3/3-way valve serving as an actuator.

Another exemplary embodiment of the invention that is schematically depicted in FIG. 8 will be explained below. The injection system shown there also includes a fuel tank 83 connected to a high-pressure pump 84. The high-pressure pump 84 is connected to a pressure reservoir 85. Once again, a fuel injector is labeled with the reference numeral 1. In contrast to the exemplary embodiment of the invention shown in FIG. 7, in lieu of the two 2/2-way valves 15, 16, only a single magnetic actuator 89 embodied in the form of a 3/3-way valve is provided, whose inlet side communicates with the first outlet throttle 17, the second outlet throttle 18, and the discharge line 4 of the spring chamber 86.3 of the pressure booster 86. This exemplary embodiment of the invention is characterized in that instead of two magnetic actuators, only a single magnetic actuator 89 is provided, which has an expanded function. There is no limitation to the basic function of the fuel injector, except for a slight reduction in the design freedom. The second outlet throttle 18 and the pressure booster 86 can be activated only if the first outlet throttle 17 and the magnetic actuator 89 have been opened earlier or are opened at the same time as them. This exemplary embodiment, however, offers the advantage of requiring only a single magnetic actuator 89 or piezoelectric actuator to be integrated into the fuel injector and triggered.

This exemplary embodiment of the invention also includes three distinguishable control variants that can be predetermined through a corresponding control of the magnetic actuator 89. In this connection, the magnetic actuator 89 or a piezoelectric actuator that is used can assume three different switched positions S0, S1, and S3.

In the first switched position S0 of the magnetic actuator 89, the outlet lines of the two outlet throttles 17, 18 and the discharge line 86.4 of the spring chamber 86.3 of the pressure booster 86 are closed. This means that no injection is occurring or that an injection event is in the process of being terminated.

In the second switched position S1 of the magnetic actuator 89, only a single outlet throttle, namely the outlet throttle 17, controls the injection quantity. The available injection pressure corresponds to the pressure level in the pressure reservoir 85. In addition, the achievable needle speed of the nozzle needle of the fuel injector lies in the range of already proven designs.

In a third switched position S2 of the magnetic actuator 89, the injection quantity is simultaneously controlled via the two outlet throttles 17 and 18, in connection with a pressure increase executed by the pressure booster 86. The injection pressure thus produced is significantly greater than the pressure level in the pressure reservoir 85 and in actual practice, can reach up to 1.5 to 3 times this pressure level. As has already been explained above, the pressure boosting that can be achieved by means of the pressure booster 86 depends on the piston area ratio between the high-pressure and low-pressure sides of the pressure booster 86.

The foregoing relates to preferred exemplary embodiments of the invention, it being understood that other variants and embodiments thereof are possible within the spirit and scope of the invention, the latter being defined by the appended claims.

The invention claimed is:

1. A fuel injector in injection systems for internal combustion engines, the fuel injector comprising, a valve body (2) containing a control chamber (19) whose pressure can be relieved, which control chamber can be acted on with fuel via an inlet throttle (32) and can be pressure-relieved via a first outlet throttle (17) with a closing element (43) which can be actuated by an actuator (15), and the valve body (2) having connected to a holding body (5) that has a nozzle body (9) connected to it, which encompasses an injection valve element (11), an additional outlet throttle (18), and an additional actuator (16) operable to actuate a closing element (49) of the additional outlet throttle (18) wherein the valve body (2) has a central high-pressure connection (3) that uses fuel to act on a nozzle chamber (12) encompassing the injection valve element (11) in the nozzle body (9), and wherein the fuel in the nozzle chamber (12) flows in via an inlet bore (36, 57), which is embodied in the valve body (2) and in the holding body (5) and extends parallel to the central bore 6 in the holding body (5).

2. The fuel injector according to claim 1, wherein the first outlet throttle (17) and the additional outlet throttle (18) are disposed opposite from each other inside the valve body (2).

3. The fuel injector according to claim 1, wherein the first and additional outlet throttles (17, 18) are provided in inserts (30) disposed on opposite sides from each other inside the valve body (2).

4. The fuel injector according to claim 3, wherein the first and additional outlet throttles (17, 18) are contained in inserts (30) and can be interchanged with other inserts, the inserts (30) being fastened in the valve body (2) by means of valve clamping screws (29).

5. The fuel injector according to claim 1, wherein the inlet throttle (32) is provided in an interchangeable insert piece (35), which is affixed in the valve body (2) by means of a high-pressure fitting (31).

6. The fuel injector according to claim 5, wherein the inlet throttle (32) of the control chamber (19) in the valve body (2) is disposed opposite from a pressure measurement connection (34) that contains a throttle restriction.

7. The fuel injector according to claim 1, wherein the orientation of the inlet throttle (32) of the control chamber (19) is rotated by 90° in relation to the first and second outlet throttles (17, 18).

8. The fuel injector according to claim 1, wherein the closing elements (43, 49) respectively associated with the outlet throttles (17, 18) are embodied as spherical.

9. The fuel injector according to claim 1, wherein the first and second outlet throttle (17, 18) are provided in inserts (30) disposed on opposite sides from each other inside the valve body (2), and wherein the closing elements (43, 49) respectively associated with the outlet throttles (17, 18) are embodied as conical bodies that cooperate with a seat (48) embodied in the inserts (30).

10. The fuel injector according to claim 1, wherein the first and second actuator (15, 16) are embodied as solenoid valves.

11. The fuel injector according to claim 1, wherein the first and second actuator (15, 16) are embodied as piezoelectric actuators.

12. The fuel injector according to claim 1, wherein the holding body (5) is interchangeably fastened to the valve body (2).

13. The fuel injector according to claim 12, wherein the holding body (5) is fastened to the valve body (2) by means of a clamping nut (4).

14. The fuel injector of claim 1 wherein the closing element (49) of the additional outlet throttle (18) is operable as a function of the power supply (70, 73, 79) to a double-switching actuator (50) in order to relieve the pressure in the control chamber (19).

15. The fuel injector according to claim 14, wherein the double-switching actuator (50) is embodied as a solenoid valve whose magnet coil (50.1) triggers a first and second valve (60, 61), which are associated with the first and second outlet throttle (17, 18), in a slightly time-delayed fashion or one after the other, depending on the power supply to the magnet coil (50.1).

16. The fuel injector according to claim 15, wherein the power supply to the magnet coil (50.1) occurs with a first power supply curve (70) for the first valve (60) and with a second power supply curve (73) for the second valve (61) and the power supply curves (70, 73, 79) each include a current step-up (72, 75).

17. The fuel injector according to claim 16, wherein during a second valve movement (78), the first valve (60) and the second valve (61) are triggered with a second power supply curve (73) and open in a slightly time-delayed fashion.

18. The fuel injector according to claim 15, wherein, during the valve movement (77), only the first valve (60) opens, which is powered with a first power supply curve (70).

19. The fuel injector according to claim 15, wherein the first valve (60) is triggered with a first power supply curve (70) during a first triggering period (77) and during a joint triggering period (80) of the first and second valves (61, 61), the second valve (61) can be powered with the third power supply curve (79).

20. The fuel injector according to claim 14, wherein the double-switching actuator (50) is embodied as a solenoid valve.

21. The fuel injector according to claim 14, wherein the double-switching actuator (50) is embodied as a piezoelectric actuator.

22. The fuel injector according claim 1, further comprising a pressure booster (86) with a piston (86.1) loaded by a spring (86.2), and wherein the low-pressure side of the pressure booster (86) is connected to a pressure reservoir (85) and the high-pressure side of the pressure booster (86) is connected to the nozzle chamber (12) of the fuel injector (1).

23. The fuel injector according to claim 22, wherein the piston area ratio between the high-pressure side and the low-pressure side of the pressure booster (86) lies in a range from 1:1.5 to 1:3.

24. The fuel injector according to claim 22, wherein the spring chamber (86.3) of the pressure booster (86) is connected via a discharge line (86.4) to the connection of the second outlet throttle (18) oriented away from the control chamber (19) of the fuel injector (1).

25. The fuel injector according to claim 22, wherein the pressure booster (86) includes a check valve (87) that closes off the high-pressure side of the pressure booster (86) from the low-pressure side of the pressure booster (86).

26. A method for controlling a fuel injector according to claim 22, comprising supplying power to the first magnetic actuator (15) or a piezoelectric actuator to cause the first outlet throttle (17) to open, thus relieving the pressure of the control chamber (19) of the fuel injector (1), and the resulting opening of the nozzle needle initiates the injection process.

27. A method for controlling a fuel injector according to claim 22, comprising supplying power to the second magnetic actuator (16) or a piezoelectric actuator to cause the second outlet throttle (18) and also the discharge line (86.4) of the spring chamber (86.3) of the pressure booster (86) to open, wherein the resulting relief of the pressure in the control chamber (19) of the fuel injector (1) causes the nozzle needle to open and the movement of the piston (86.1) of the pressure booster (86) causes the nozzle chamber (12) of the fuel injector (1) to be acted on with a pressure that exceeds the pressure level in the pressure reservoir (85).

28. A method for controlling a fuel injector according to claim 22, comprising supplying power to both of the magnetic actuators (15, 16) or a piezoelectric actuator to cause both outlet throttles (17, 18) to open, wherein the resulting relief of the pressure in the control chamber (19) of the fuel injector (1) causes the nozzle needle to open and the movement of the piston (86.1) of the pressure booster (86) causes the nozzle chamber (12) of the fuel injector (1) to be acted on with a pressure that exceeds the pressure level in the pressure reservoir (85).

* * * * *